United States Patent [19]

Mutarelli et al.

[11] Patent Number: 5,076,803

[45] Date of Patent: Dec. 31, 1991

[54] LOCKING CONNECTOR ASSEMBLY

[75] Inventors: Daniel L. Mutarelli, Merrimack; Joseph A. Roberts, Hudson, both of N.H.

[73] Assignee: Miraco, Inc., Nashua, N.H.

[21] Appl. No.: 661,486

[22] Filed: Feb. 22, 1991

[51] Int. Cl.[5] ..... H01R 13/00

[52] U.S. Cl. ..... 439/493

[58] Field of Search ..... 439/492–499

[56] References Cited

U.S. PATENT DOCUMENTS

| | | | |
|---|---|---|---|
| 4,890,381 | 1/1990 | DuBois et al. | 439/495 |
| 4,955,814 | 9/1990 | Christie et al. | 439/493 |
| 5,015,197 | 5/1991 | Redmond et al. | 439/493 |

*Primary Examiner*—Joseph H. McGlynn
*Attorney, Agent, or Firm*—Hale and Dorr

[57] ABSTRACT

A connector assembly for connecting a flexible printed circuit or flat conductor tape cable with exposed terminal pads to the thru-hole terminals of a PC board or second flexible printed circuit includes a socket and conductive posts. Corresponding first ends of the posts project into the socket and corresponding second ends of the posts project from the bottom of the header for insertion into the PC board or second flexible printed circuit terminals. A connector is mounted to the end of the flexible circuit or flat conductor tape cable and it has post-receiving passages for receiving the post first ends so that those ends are electrically connected to the terminals pads of the flexible circuit or flat conductor tape cable when the connector is inserted into the header socket. Provision is also made for locking the connector in the header socket.

9 Claims, 2 Drawing Sheets

LOCKING CONNECTOR ASSEMBLY

FIELD OF THE INVENTION

This invention relates to a printed circuit connection assembly. It relates more particularly to a connector for releasably mechanically and electrically connecting an inline, single plane, straight conductor of a flexible printed circuit or flat conductor tape cable to a staggered terminal pattern of a printed circuit board.

BACKGROUND OF THE INVENTION

In electrical systems, flexible printed circuits and flat conductor tape cables are often employed as electrical jumper cables for interconnecting the terminals of printed circuit (PC) boards comprising the various subsystems. A connector mounted to one or both ends of the cable is formed with a set of electrical contacts which are designed to engage corresponding terminals of a printed circuit board. Some connectors, such as the one shown in U.S. Pat. No. 4,225,205, require individual soldered connections between the contacts of the connector and the cable conductors or between the connector contacts and the terminals of the PC board. Since there may be a large number of conductive paths involved, the connection of the connector to the cable or to the PC board can be a tedious and time-consuming process. Furthermore, there is a great potential for misconnection of the various printed circuit paths to the connector due to solder bridging of adjacent circuit paths or due to a dead solder connection. Also, if connections are to be made in the field, this requires a technician to carry a soldering gun which can be inconvenient. Moreover, such solder connections are permanent for all practical purposes.

U.S. Pat. Nos. 4,531,793 and 4,583,800 are illustrative of connectors which avoid the need to solder when connecting a flexible printed circuit to a printed circuit board. In these arrangements, the connector is basically a spring-like clamp which clamps the printed circuit paths of the flexible circuit or flat conductor tape cable to congruent circuit paths of the PC board. While this type of connector is releasable, the connection is possible only when the circuit path terminations of both circuits being connected are planar or flat, i.e. are pads. Such connectors cannot be used to establish contacts with a PC board whose terminals are in the form of thru-holes.

In U.S. Pat. No. 4,740,867, there is shown a printed circuit connection system wherein the flexible printed circuit or flat conductor tape cable is terminated by a connector which defines a set of post-receiving passages or sockets. The connector is clamped to the end of the circuit so that the conductor runs are aligned with the connector passages, each conductor forming one wall of the corresponding passage. The connector is arranged to be coupled to a PC board with the connector passages receiving terminal posts or pins projecting from the PC board. The connector includes a comb-like spring member which biases the conductive cable runs against the terminal pins projecting into the connector passages so that the various conductor runs are in intimate electrical and mechanical contact with the posts of the PC board.

That prior connection system thus requires that the various conductive paths or runs of the PC board be terminated by upstanding pins or posts capable of being plugged into the connector passages. The connector disclosed in that patent is not capable of being connected to the widely used type of PC board whose conductive runs terminate in a staggered pattern designed to separate thru-holes to provide space for inner layer conductor feed through and to prevent solder bridging. That conventional connection system is disadvantaged also in that the connector is retained to the PC board solely by the frictional engagement of the cable runs and the terminal pins of the PC board. Resultantly, when a system incorporating such connections is operating in a high vibration environment, vibratory forces can result in the connector and PC board pins becoming disconnected.

SUMMARY OF THE INVENTION

The present invention aims to provide a printed circuit connector assembly which releasably connects the printed circuit paths of a flexible circuit or flat conductor tape cable to a PC board whose conductive runs are terminated in a random pattern via thru-holes.

Another object of the invention is to provide such an assembly which releasably locks the connector at the end of the circuit to the PC board so that the connector cannot be disconnected inadvertently from the PC board.

A further object of the invention is to provide a connector assembly of this type which can connect very closely packed circuit terminals in random patterns.

Still another object of the invention is to provide a connector assembly for connecting a flexible circuit or flat conductor tape cable to the terminals of a PC board in such a way as to establish reliable electrical connections between the corresponding circuit paths of the two circuits.

Yet another object is to provide a connector assembly of this type which is relatively easy and inexpensive to make in quantity.

A further object of the invention is to provide such an assembly which can be used to connect a flexible circuit or flat conductor tape cable, whose terminal ends are arranged in a parallel pattern to a PC board whose terminals are arranged in a staggered, offset pattern or in a dual in-line parallel (DIP) array.

Other objects will, in part, be obvious and will, in part, appear hereinafter. The invention accordingly comprises the features of construction, combination of elements and arrangement of parts which will be exemplified in the following detailed description, and the scope of the invention will be indicated in the claims.

Briefly, the present connector assembly comprises a special locking header which includes a set of posts or pins, corresponding first ends of which plug into the thru-holes terminating the various conductor runs of a PC board or wiring board of conventional design. Often such thru-holes are arranged in one or more rows adjacent to an edge of the PC board. The system also includes a connector clamped to the end of a flexible circuit or flat conductor tape cable and arranged to connect the various flexible circuit paths of the circuit to the opposite ends of corresponding pins or posts of the header when the connector is coupled to the header.

The header itself includes a housing whose length is commensurate with the length of the array of thru-holes in the PC board. The header's pins or posts project from the bottom wall of the header and the post ends under the header are the aforementioned first ends that extend through the holes of the PC board when that bottom wall is positioned flush against the board. An opening is formed in the opposite or top wall of the header to define a socket for receiving the connector at the end of the circuit. The header's pins or posts extend up from the floor of the socket with the upper or opposite ends of the posts being located near the mouth of the socket so that the connector is plugged into the header socket, those upper ends extend into a corresponding set of passages in the end of the connector.

The connector defines an internal cavity containing an end segment of the circuit. Also mounted inside the cavity is a spring member having individual leaf springs or tines which bias the circuit conductors toward the header posts which extend through the connector passages into the cavity. The spacing of the circuit conductors corresponds to that of the header pins so that when the connector is plugged into the header, the circuit conductors are pressed against the header pins so that a good wiping electrical contact is made between each header post and each circuit conductor.

Preferably, the connector and header socket are shaped so that the connector has to be oriented properly in order to be inserted into the socket. Also, the assembly incorporates a locking mechanism to lock the connector to the header so that there is no likelihood of the connector pulling out of the header socket under the influence of vibration or shock forces.

In the present assembly, the header is mounted to the PC board by plugging the header posts into the corresponding thru-holes of the PC board. Preferably, solder fillets are provided between the header posts and the thru-holes to permanently join those two components of the assembly. Also, the connector is clamped to the end of the circuit, such clamping automatically aligning the conductive circuit runs with the connector passages that are to receive the header posts when the connector is coupled to the header. The connector is then coupled to the header by inserting it into the header socket. Visual access is not necessary in order to line up the connector sockets with the set of posts in the header; this is done automatically when the connector is inserted into the header socket. As noted previously, the connector will not fit into the socket unless it is oriented properly. Thus, the connection can be made by feel alone even in a congested area.

When the connector is seated properly in the header, the locking mechanism maintains such seating. Yet, if it should become necessary to decouple the connector from the header, this can be accomplished quite easily by releasing the locking mechanism while pulling the connector away from the header. Actually, the connector and header may be connected and disconnected many times without the connector losing its ability to establish good electrical contacts between the conductor paths of the circuit and the posts of the header.

In applicant's connection assembly, the circuit and PC board are standard constructions and the header may be formed to connect the same circuit connector to a single row of closely spaced thru-holes on the PC board or to a less densely packed array of holes consisting of, say, two rows of holes simply by changing the geometry of the header posts, as will be described in more detail later.

With all of the above advantages, the connection assembly is still relatively inexpensive to make in quantity so that it should find wide application wherever it is necessary to releasably and reliably connect a flexible circuit or flat conductor tape cable to the thru-hole terminals of a PC board.

BRIEF DESCRIPTION OF THE DRAWINGS

For a fuller understanding of the nature and objects of the invention, reference should be had to the following detailed description, taken in connection with the accompanying drawings, in which.

DETAILED DESCRIPTION OF PREFERRED EMBODIMENTS

Figure 1:
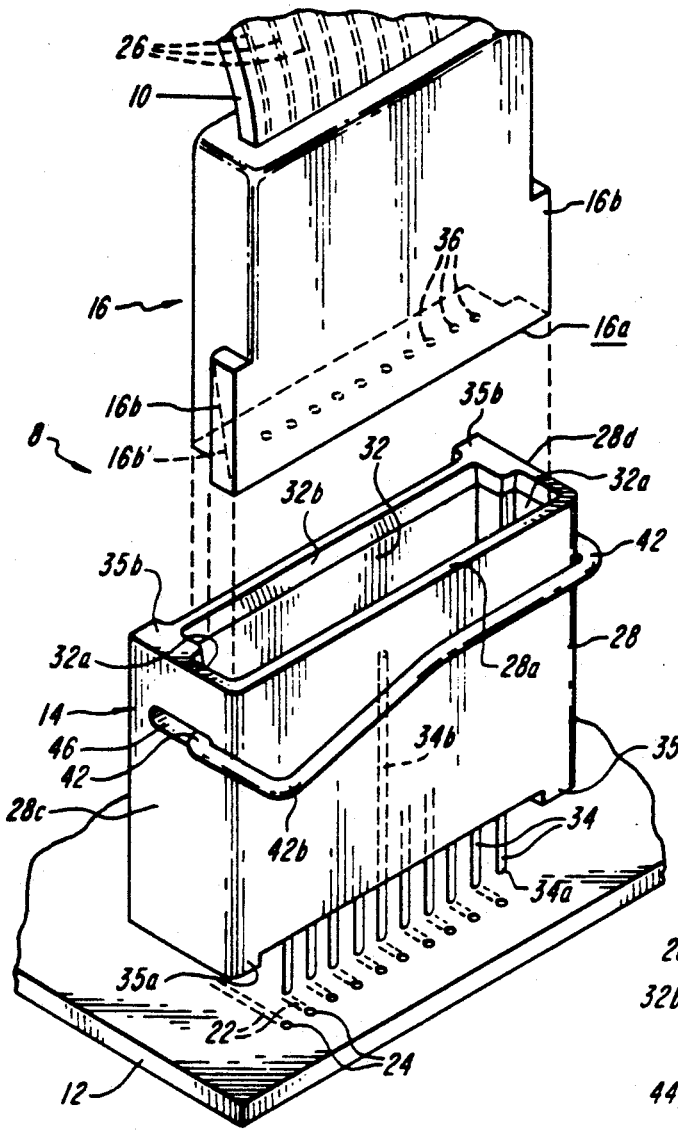
FIG. 1 is a fragmentary exploded isometric view showing a printed circuit connector assembly embodying this invention.

Referring to FIG. 1 of the drawings, our connection assembly, shown generally at 8, comprises a flexible circuit or flat conductor tape cable 10 adapted to be connected to a PC board or printed wiring board 12 by a header 14 mounted to the board 12 and a cable connector 16 releasably coupled to the header. The PC board is a conventional circuit which carries an array of conductive circuit paths or runs 22 which are terminated at thru-holes 24, usually arranged in a row on the board, often adjacent to an edge thereof as shown in FIG. 1. In a PC board with a single row of thru-holes 24, the holes may be spaced-apart, say, 0.050 inch on center.

The flexible circuit or flat conductor tape cable 10 is also of more or less conventional construction in that it has a pattern of conductive paths 26 leading to an end of the circuit where those paths are terminated by exposed pads **26*a* (FIG. 2) arranged in a row adjacent to the end of the circuit. In the assembly depicted in FIG. 1, the jumper cable 10 is designed to suit the PC board 12, in that the placement of its terminal pads 26*a* corresponds to the placement of the row of thru-holes 24** on PC board.

The header 14 comprises a rigid housing 28 molded of a suitable impact resistant, electrically insulating material, such as polyethylene terephthalate. Housing 28 is generally rectangular with a length somewhat greater than the length of the row of thru-holes 24 on PC board 12. The housing 28 is formed with a recess or socket 32 extending down from the housing top wall **28*a* almost to the header bottom wall 28*b*. A pair of vertical channels 32*a* are formed at opposite ends of socket 32 adjacent to one side wall thereof which function as keyways for the connector 16 as will be described later. Also, the mouth of socket 32 is provided with beveled edges 32*b* to facilitate entry of the connector 16 into header 14**.

Figure 2:
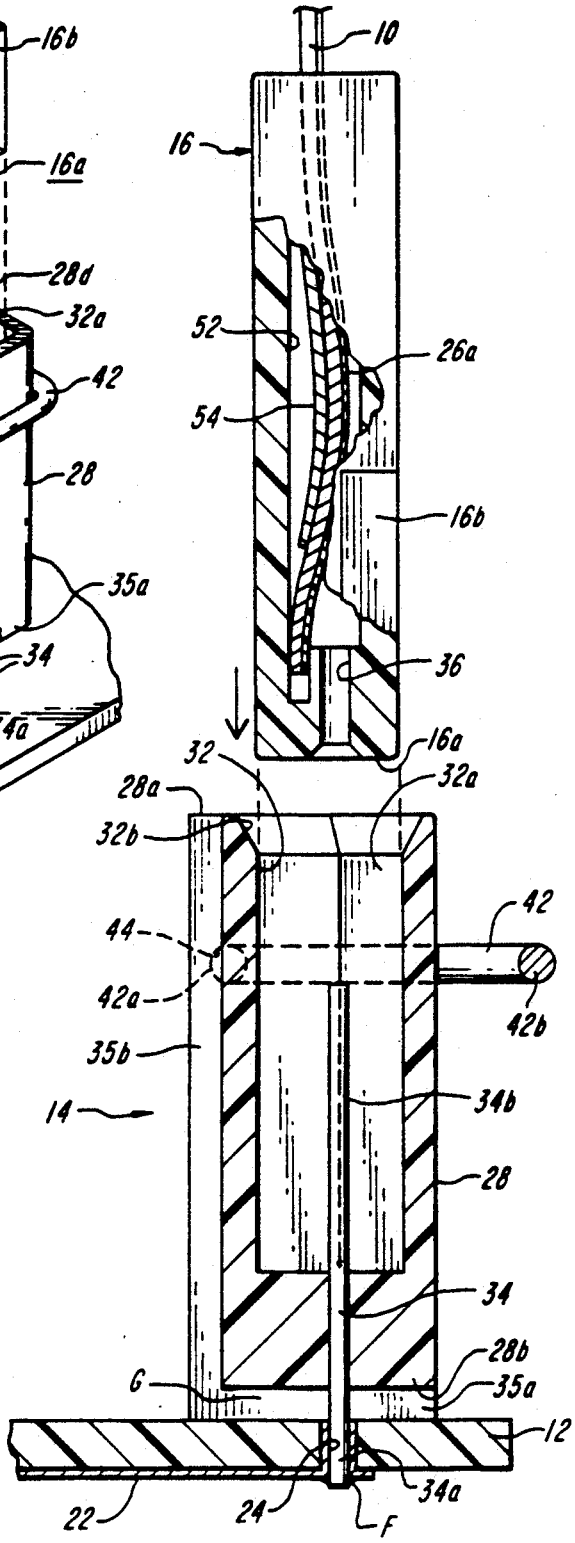
FIG. 2 is a fragmentary side elevational view, on a larger scale and with parts broken away, showing the connector component of that assembly being inserted into the assembly header.

Molded into the bottom wall 28b of housing 28 at the time that the housing is formed is a row of upstanding wire posts or pins 34. The lower end segments 34a of these posts project below housing 28 and are arranged to plug into the thru-holes 24 of the PC board when the housing bottom wall 28b is positioned against the upper face of the PC board 12 as shown in FIG. 2. Since in the illustrated assembly, the holes 24 are spaced in the order of 0.050 inches apart, the posts 34 have comparable spacings. Also, the post segments 34a are long enough so that when the header is positioned against the surface of the PC board, as shown in FIG. 2, the post segments 34a project through the plated holes 24.

Actually, for best results, the opposite end walls 28c and 28d of housing 28 should extend below the segment of the housing bottom wall 28b containing the row of post 34 to form ribs or pedestals 35a so that a gap G remains between the housing bottom wall 28b and the PC board where the posts 34 are located. This gap G provides egress for any solder debris that may be present when the header is permanently connected to the PC board in a manner to be described later. Therefore, the length of the post segments 34a should be slightly greater than the thickness of the PC board plus the height of gap G.

Similar ribs 35b may be provided at the ends of the housing rear wall remote from channels 32a because sometimes the header is mounted sideways to the board. In this event, the post segments 34a are provided with right angle bends (not shown) so that their ends project beyond that side wall.

Posts 34 also have upper segments 34b which project up from the floor of socket 32 a substantial distance towards the mouth of the socket. The header socket 32 is shaped and dimensioned to receive the circuit connector 16 which has a row of passages 36 in its bottom wall 16a for receiving the header post segments 34b when the connector is inserted into the header socket 32. Preferably, the connector 16 is provided with a pair of tabs 16b which project out from opposite ends of the connector adjacent to one side thereof. Tabs 16b extend only part way up on connector 16 and they are arranged to key into the channels 32a present at the opposite ends of the header socket 32. The tabs and channels thus function as keys and keyways to prevent the connector from being inserted backwards into the header socket 32. This prevents the connector from making incorrect connections between the circuit conductors 26 and the header posts 34.

Figure 4:
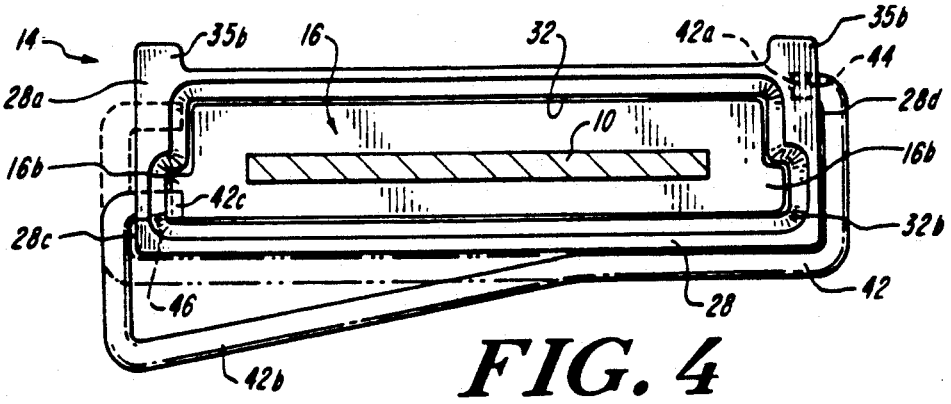
FIG. 4 is a sectional view taken along line 4—4 of FIG. 3.
Figure 5:
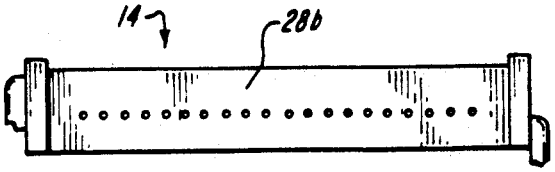
FIG. 5 is a bottom plan view on a smaller scale showing the arrangement of the posts in the header component of the FIG. 1 assembly.

Preferably our connection assembly also includes provision for locking the connector 16 to header 14 once the connector is inserted into the header socket 32. As best seen in FIGS. 1 and 4, the locking mechanism includes a resilient wire bail 42 which extends around the front wall of header 14 adjacent to channels 32a. Bail 42 also has a segment which extends parallel to the header housing end wall 28d with the free end 42a of that bail segment being hooked into a hole 44 formed in the housing end wall 28d as best seen in FIG. 4. Bail 42 extends horizontally part way along the front wall of housing 28 and then angles out away from that wall before turning back parallel to the housing end wall 28c thereby forming a generally triangular lock handle 42b at the front of header 14. Bail 42 is turned back on itself at the remaining segment 42c thereof and that end segment projects into the header socket 32, or more particularly into the lefthand channel 32a, through a horizontal slot 46 in the header housing end wall 28c.

Figure 3:
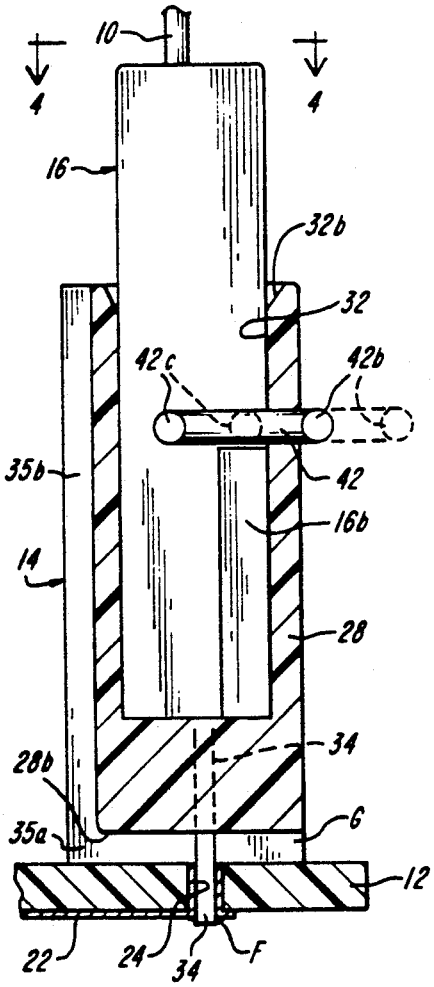
FIG. 3 is a similar view showing the connector fully coupled to the header.

In its normal unstressed state, bail 42 reposes with its end segment 42c located at the righthand end of slot 46, as shown in solid lines FIGS. 1 and 4. This is the locking position of the bail. The bail may be moved to its unlocking position by pressing the bail handle 42b toward housing 28. This shifts the bail end segment 42c toward the left end of slot 46 as shown in solid lines in FIG. 3 and in phantom in FIG. 4. As best seen in FIG. 3, slot 46 is positioned in elevation on header 14 such that when connector 16 is seated in the header socket 32, the slot overlies the lefthand connector tab 16b.

Except for its tabs 16b, the connector 16 may be substantially identical to the one disclosed in the aforementioned U.S. Pat. No. 4,740,867, the contents of which is hereby incorporated by reference. Suffice it to say that, as shown in FIG. 2, the passages 36 in the bottom wall of the connector lead into a cavity 52 the connector which houses the end segment of circuit 10 including the conductors 26a thereon. That circuit segment is positioned in the cavity so that pads 26a are aligned With the connector passages 36. A comb-like spring member 54 is positioned in cavity 52 behind the circuit segment containing exposed conductors 26a so as to bias the individual conductors 26a toward the opposite wall of cavity 52 so that those pads overlie passages 36. Thus, when connector 16 is inserted into the header socket 32, the header post segments 34b in header socket 32 project through passages 36 into cavity 52 so that they are resiliently contacted by the circuit conductors 26a.

To assemble the components of assembly 8, the header 14 is mounted to PC board 12 by seating the header housing against PC board 12 so that the header post segments 34a project through the thru-holes 24 of the PC board, as shown in FIG. 2. The header may be permanently connected, both electrically and mechanically, to the PC board by applying solder fillets F around the ends of post segments 34a at the underside of the PC board as shown in FIGS. 2 and 3. Also, the connector 16 is clamped to the end of the circuit 10, as described in the aforesaid patent so that the circuit conductors 26a are aligned with the connector passages 36.

All that remains, then, is to couple connector 16 to the header by pressing the locking bail handle 42b toward the header housing 28 to the position shown in solid lines in FIG. 3 and in phantom in FIG. 4 and inserting connector 16 into the header socket 32. Since the connector has to be oriented properly in order to be inserted into the header receptacle, the circuit runs 26 are automatically connected to the proper PC board runs 22. After the connector is seated in the header, the locking bail handle 42b is released allowing the bail to spring back so that its end segment 42c overlies the lefthand connector tab 16b as shown in phantom in FIG. 3 and in solid lines in FIG. 4. This positions bail end segment 42c over connector tab 16b thereby preventing the connector from being pulled out of the header socket. To decouple the connector from the header, the bail handle 42b is pressed toward the header housing so that the bail segment 42c is pushed beyond the connector tab 16b as shown in solid lines in FIG. 3 and in phantom in FIG. 4 which allows the connector to be pulled out of the header socket 32.

In order to avoid having to press the bail handle 42b when inserting the connector 16 into the header socket 32, the connector tabs 16b (or at least the lefthand tab) may be wedge shaped as shown in phantom at 16b' in FIG. 1. That tab then forms a ramp which will wedge the bail segment 42c leftward along slot 46 as the connector is being inserted into the header. When the connector is seated, the bail will automatically spring back to its locking position in which the bail end segment 42c overlying that tab 16b'.

The header depicted in FIGS. 1 to 5 is able to connect the circuit 10 and its connector 16 to a single row of closely spaced-apart thru-holes 24 in PC board 12.

Figure 6:
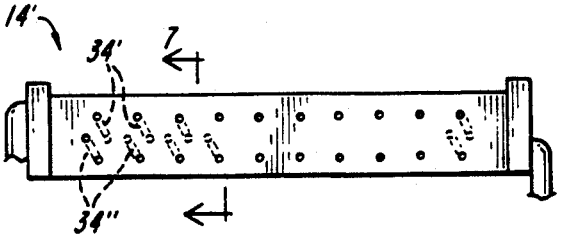
FIG. 6 is a similar view illustrating the header with a different post configuration for connection to a PC board having plated holes arranged in a DIP array.
Figure 7:
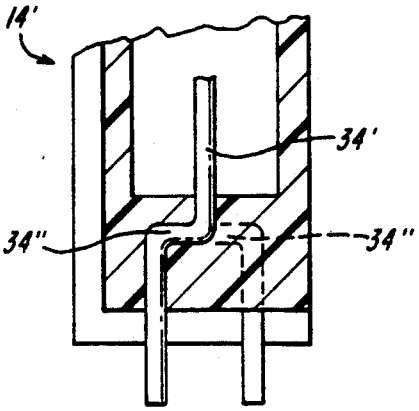
FIG. 7 is a sectional view taken along line 7—7 of FIG. 6.

FIGS. 6 and 7 depict another header embodiment 14' which is able to connect the same connector 16 to a less densely packed dual in-line parallel array of holes on a PC board. The header 14' illustrated in FIGS. 6 and 7 is identical to header 14 described above except that it incorporates modified header posts 34'. Instead of being straight like posts 34, each header post 34' is provided with an offset 34'' within the header housing bottom wall, which offset extends towards either the front or the rear wall of the header. Thus, while the upper post segments which extend into the header socket are arranged in a single line as they are in header 14, the lower post segments which project from the bottom wall of header 14' are offset to the positions shown in FIGS. 6 and 7 wherein those post segments are arranged in two parallel rows which extend along the header 14'. Preferably, the lower post segments in each row are spaced twice as far apart as the post segments projecting into the header socket. That is, whereas the spacing of the upper post segments may be 0.050 inch, the spacing of the lower post segments in each row may be 0.100 inch.

Other post geometries can be envisioned which will enable the same connector 16 to connect to PC boards with other different thru-hole arrays.

As seen from the foregoing, my connector assembly provides an efficient and effective means to connect a flexible circuit or flat conductor tape cable to a PC board or card whose conductor runs are terminated at thru-holes. The header component of the assembly can establish the proper electrical connections between a connector at the end of the circuit and the thru-holes of the PC board when those holes are arranged in a single row or in plural rows or other hole arrays, depending upon the design of the header posts which plug into those holes. When the connector is inserted into the header socket, it is releasably retained there by the locking mechanism on the header so that there is little likelihood of the connector pulling away from the header when the assembly is used in a high vibration environment. These advantages, plus the cost advantage discussed above, make the assembly an effective solution to the problem of establishing high density electrical connections between a flexible circuit or flat conductor tape cable and a printed circuit board.

It will thus be seen that the objects set forth above, among those made apparent from the preceding description, are efficiently attained and, since certain changes may be made in the above construction, without departing from the scope of the invention, it is intended that all matter contained in the above description or shown in the accompanying drawings, shall be interpreted as illustrative and not in a limiting sense.

It will also be understood that the following claims are intended to cover all of the generic and specific features of the invention described herein.

We claim:

1. A printed circuit connector assembly comprising a circuit board having an array of thru-hole terminals;

a flexible circuit or flat conductor tape cable having an end segment carrying a row of conductive areas on one surface thereof;

a connector mounted to said circuit end segment, said connector having an interior cavity containing said circuit end segment, a row of passages extending from without into said cavity parallel to and in register with said conductor areas and biasing means in said cavity for engaging and flexing said circuit end segment so that said conductive areas therein overhang said passages; and a header defining a socket for receiving said connector, said header including a set of conductive posts mounted in the floor of said socket, said posts having corresponding first end segments extending from the socket floor toward the mouth of the socket, said first segments being arranged in number and location to plug into corresponding ones of said connector passages when the connector is inserted into said socket so that said post upper segments are resiliently engaged by and electrically connected to the conductor areas overhanging corresponding ones of said conductor passages, said header posts also having second segments which project out through the opposite face of said socket floor, said second segments being arranged in an array which corresponds to the terminal array of the PC board so that said post second segments can be received in for electrical connection to those terminals.

2. The connector assembly defined in claim 1 wherein said terminals are arranged in a single row and said post first and second segments are arranged in a single row, the centerline spacings of said terminals and said post segments being the same.

3. The connector assembly defined in claim 1 wherein said terminals and said post second segments are arranged in a corresponding plurality of rows, the centerline spacings of said terminals and said post second segments being the same; and said post first segments are arranged in a single row.

4. The connector assembly defined in claim 1 and further including cooperating means on said connector and said header which allow only one way to insert the connector into the header socket.

5. The connector assembly defined in claim 1 wherein said post second segments are received in said terminals; and further including fixation means for mechanically and electrically connecting said post second segments permanently to said terminals.

6. The connector assembly defined in claim 5 wherein said fixation means comprise solder fillets.

7. The connector assembly defined in claim 6 and further including spacer means extending out from said socket floor opposite face to space said header from said circuit board when said post second segments are received in said terminals.

8. The connector assembly defined in claim 1 and further including cooperating means on said connector and said header for releasably locking said connector in said header socket.

9. The connector assembly defined in claim 8 wherein said locking means comprise a projection on the exterior of said connector;

a slot extending through a wall of said header into the header socket, said slot having a first end segment that is located just above said projection when said connector is inserted into said socket; and a resilient locking member mounted to the exterior of said header, said member having a portion that extends through said slot into said cavity, said member being movable between a stable unstressed first position wherein said member portion is positioned in said slot first end segment and an unstable second position wherein said member portion is positioned along said slot away from slot first end segment.

* * * * *